United States Patent [19]

Marsing et al.

[11] Patent Number: 4,769,623

[45] Date of Patent: Sep. 6, 1988

[54] MAGNETIC DEVICE WITH CURVED SUPERCONDUCTING COIL WINDINGS

[75] Inventors: Helmut Marsing, Neunkirchen; Konrad Meier, Erlangen; Andreas Jahnke, Forchheim, all of Fed. Rep. of Germany

[73] Assignee: Siemens Aktiengesellschaft, Munich, Fed. Rep. of Germany

[21] Appl. No.: 86,973

[22] Filed: Aug. 19, 1987

[30] Foreign Application Priority Data

Jan. 28, 1987 [DE] Fed. Rep. of Germany ..... 3702389

[51] Int. Cl.[4] ..... H01F 7/22

[52] U.S. Cl. ..... 335/216; 335/299; 328/235

[58] Field of Search ..... 335/210, 213, 216, 299; 328/235

[56] References Cited

U.S. PATENT DOCUMENTS 3,283,276 11/1966 Hritzay ..... 335/299 X
4,200,844 4/1980 Nunan ..... 328/234 X
4,667,174 5/1987 MacKinnon et al. ..... 335/299

*Primary Examiner*—George Harris
*Attorney, Agent, or Firm*—Kenyon & Kenyon

[57] ABSTRACT

A magnetic device is arranged in a curved section of the path of electrically charged particles of an acceleration installation around a beam guiding chamber. The magnetic device contains curved coil windings built up of superconducting rectangular conductors, which have convex outsides, concave insides as well as transition regions at the coil ends between these sides. The superconducting coil windings (4*a*) according to the invention are arranged at least with their winding parts (57, 58) forming the convex outsides (53) and concave insides (54) in grooves of correspondingly formed coil formers of the magnetic device, with the grooves extending downward at least approximately perpendicular to the plane (x-y plane) determined by the particle path. In addition, the superconducting coil windings (4*a*′) in the region of their coil ends (55′) are bent up saddle-shaped. With these measures the effect of undesirable conductor motions on the exactitude of the magnetic fields generated by the coil windings can at least largely be excluded.

12 Claims, 3 Drawing Sheets

MAGNETIC DEVICE WITH CURVED SUPERCONDUCTING COIL WINDINGS

BACKGROUND OF THE INVENTION

The invention relates to a magnetic device arranged at a curved section of the orbital path of electrically charged particles in an accelerator installation. The magnetic device is arranged around a beam guiding chamber surrounding the particle orbit and the device contains curved coil windings, which windings have convex outsides, concave insides and transition regions at the coil ends between these sides. The curved coil windings are built of superconducting rectangular conductors. A superconducting coil winding for a magnetic device of this nature is evident, for example, in the EP No. 190 623.

Accelerator installations for charged particles, for example electrons, frequently have storage rings, which, because of their curved particle orbits, must be provided with correspondingly curved dipole magnets. Such installations can, in particular, also be of the so-callad racetrack type. The racetrack particle orbit is composed of two semicircles with corresponding 180° deflection magnets and of two straight orbit sections (cf. "Nucl. Instrum. and Meth.", Vol. 177, 1980, pages 411 to 416, or Vol. 204, 1982, pages 1 to 20). If the intent is to achieve high final energies, the magnetic fields of such deflection magnets can be generated, in particular, with superconducting coil windings.

The synchrotron radiation source known from DEP No. 35 30 446 also has an electron storage ring of the racetrack type. The synchroton radiation means the relative radiation emission of the electrons, which orbit at nearly the speed of light and, through deflection in a magnetic device, are kept in the proscribed particle orbit. Synchrotron radiation supplies x-ray radiation with parallel radiation characteristics and a high degree of intensity. This synchrotron radiation can advantageously be used for x-ray lithography which is especially suitable for the production of integrated circuits for generating microstructures.

In the production of the curved magnetic devices required for a storage ring, high demands are made with respect to the ability of their superconducting windings to maintain dimensions, in order to ensure the requisite field homogeneity. Appropriate windings can be built up, for example of superconducting rectangular conductors in accordance with methods evident in the above mentioned EP. Consistent with it, the conductors are wound around a central winding core with a convex outside and a concave inside as well as transition areas lying in between on a coil core and fixed. In this way, a planar winding results with the individual windings in this plane radially, with respect to the radius of curvature of the winding, arranged next to each other. In the magnetic device, the produced windings are so arranged that their winding planes come to lie at least largely parallel to the plane determined by the particle orbit.

In such radial construction of a curved superconducting coil winding however, the danger exists that when the superconductor is cooled to the operating temperature of for example 4.2 K., longitudinal changes can occur, which additionally, due to the curved winding form, differ markedly on the convex outside from those at the concave inside. Connected with this, especially at the coil ends, can be a displacement with respect to each other of the distinct conductors, which leads to undesirable field inhomogeneties.

SUMMARY OF THE INVENTION

The invention, therefore, is based upon the objective of improving the magnetic device of the above mentioned type in so far as to significantly reduce the danger of conductor displacements.

The objective is achieved by providing an improvment in a magnetic device wherein the convex outsides and concave insides of the superconducting coil windings form winding parts arranged in grooves of correspondingly formed coil formers. The grooves extend approximately perpendicular to the plane defined by the particle path and, further, the coil ends overhangs of the coil windings are bent up saddle-shaped.

The advantages associated with the appropriate design of the magnetic device can be seen to lie in particular in that through exact production and position of the groove cross sections, extending vertically with respect to the particle orbit plane, radial motions of the superconducting rectangular conductors can practically be excluded. At the coil ends the windings can be bent up saddle-shaped perpendicular upwards or downward with a relatively small radius of curvature. There, potential motions of this nature are correspondingly less critical due to the greater distance from the particle path. Beyond that, on the individual conductor stacks in the grooves in known fashion, a vertical pre stress can be exerted. In this manner longitudinal changes of the conductors and especially displacement of their ends can largely be excluded.

A problem in the layout of magnetic devices with high demands on field homogeneity represents, furthermore, the interference free position of the current supplies at the conductor ends. Since the interfering influence decreases with the distance to the particle orbit, the supply lines can advantageously leave the windings at the coil ends. The effect of the supply lines can be neglected in this manner while the curvature of the entire winding packet either upward or downward can readily be taken into account in the field generation.

Advantageous models of the magnetic device according to the invention are evident from the following detailed description of the invention.

For explanation of the invention in greater detail reference is made to the drawings.

DETAILED DESCRIPTION

Figure 1:
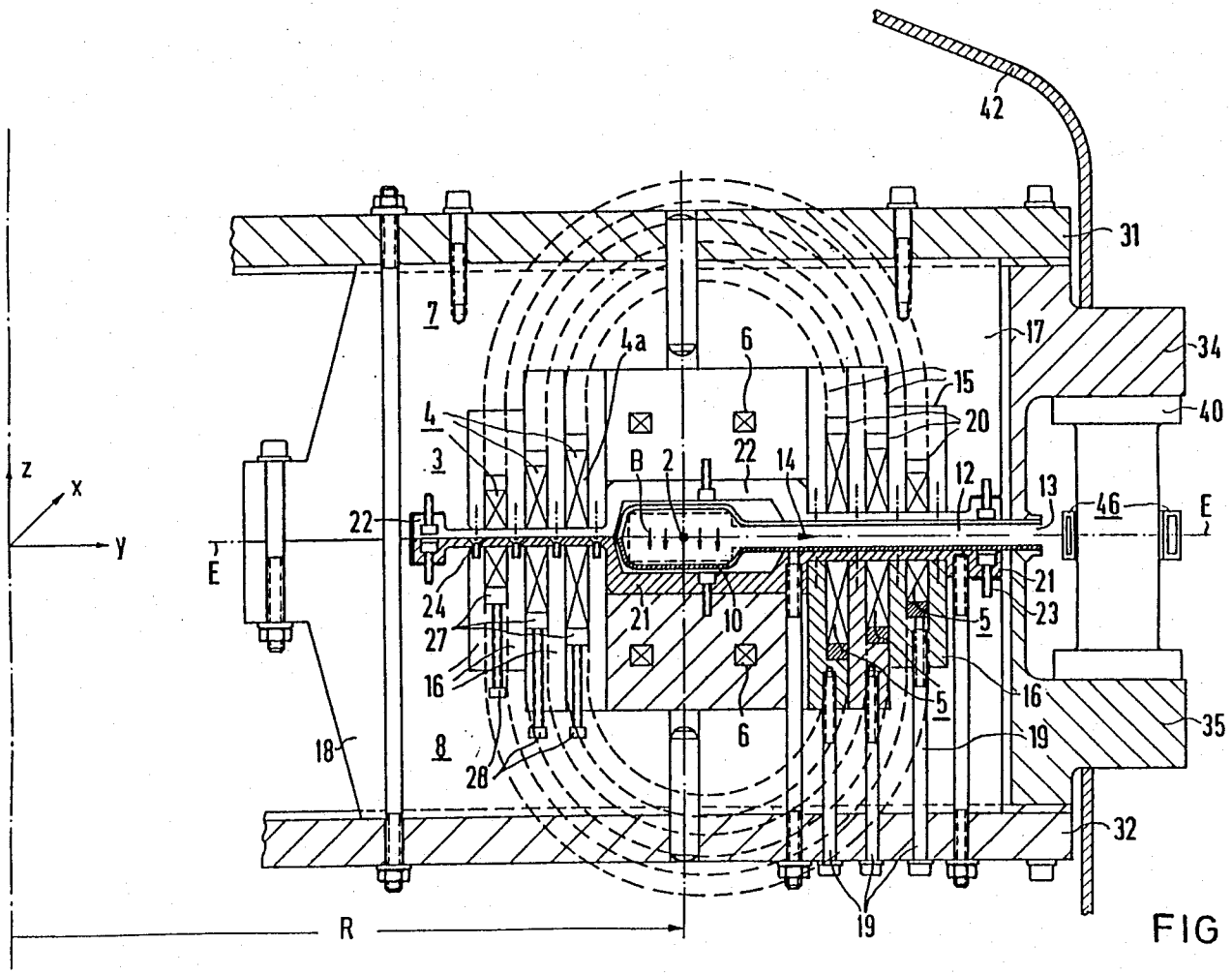
FIG. 1 represents schematically a part of a synchrotron radiation source with a magnetic device according to the invention.

In setting up the radiation source indicated in FIG. 1 a starting base is a known model, in particular of the racetrack type (cf. for example DEP Nos. 35 11 282, 35 30 446 or the publication of the "Institute for Solid State Physics" of the University of Tokyo, Japan, September 1984, Ser. B., Nr. 21, pages 1 to 29 with the title: "Superconducting Racetrack Electron Storage Ring and Coexistent Injector Microtron for Synchrotron Radiation"). In FIG. 1 there is illustrated a cross section of the orbital path 2 in the region of its 180° curved path with a corresponding magnetic device 3 according to the invention. The radius of curvature in this representation is labeled R. The magnetic device contains on each side of the equatorial plane E, defined by the particle orbit 2 extending in the x-y direction of a rectangular x-y-z system of coordinates, one curved superconducting dipole coil winding 4, 5 and, if necessary, still additional superconducting coil windings, for example correction coil windings 6. The superconducting coil windings with convex outsides, concave insides and coil ends winding overhangs between these sides, are advantageously held in identically constructed upper and lower frame structures 7, 8 which are to be joined in the equatorial plane E and in so doing enclose a radiation guiding chamber 10 enclosing the particle orbit 2. Within this chamber 10 a dipole field B of sufficient quality is developed. The chamber 10 changes radially or tangentially toward the outside into an equatorial outlet chamber 12 open on one side with an outlet aperture or port 13 for the synchrotron radiation indicated by an arrow 14. The outlet chamber can be formed, in particular slot-shaped with the particular slot consisting of the entire 180° arc of the curved particle orbit section.

The discrete superconducting dipole coil windings 4 and 5 are located at least with their convex outside and concave inside determining the winding parts in azimuthal encircling grooves 20 of correspondingly formed discrete coil formers 15 and 16 of metal or synthetic composite materials. These coil formers are set into upper and lower frame parts 17, 18 of the particular frame structure 7, 8 and are held vertically to the equatorial x-y plane E by screws 19. The winding build-up can take place advantageously from the particular groove base of the coil former in the direction toward the equatorial plane E or in the reverse direction. In this, each of a graded clamping part 21, 22 ensures the exact distances and positions of the particular winding edges toward the equatorial plane on the one hand, and increases, on the other hand, by mechanical closure with the coil formers 15, 16 and the frame parts 17, 18 the rigidity of the entire construction with respect to the radially directed Lorentz' forces. The clamping parts 21 and 22 can, additionally with the help of screws 23 and 24 seal the individual windings and thus prevent conductor motions in the region of the magnetic device 3, which can lead to premature undesirable transition of the superconducting material into the normally-conducting state, i.e. to a so-called quenching of the windings. To this end stamp-like pressure strips 27 are also provided at each particular groove base, which strips 27 are to be pressed via screws 28 against the particular winding part. In this way, the winding within the grooves are pressed together vertically from two sides. The windings or parts of them are, moreover, optionally also cast in the grooves.

The frame parts 17 and 18 of the frame structures 7 and 8 are connected rigidly with upper and lower plate elements 31, 32. The highly precise positioning of the individual superconducting coil windings 4 to 6 with respect to the particle orbit 2 is ensured. At the peripheral outside edge of the magnetic device 3 in the region of the slotted outlet opening 13 for the synchrotron radiation 14 the upper and the lower plate elements 31 and 32 of the frame structures 7, 8 are braced against annular, force-transmitting distributor parts 34 and 35. The slotted outlet chamber 12 extends toward the outside from between these distributor parts. The mutual distance and dynamic bracing between the distributor parts 34 and 35 via at least one support element 40 is ensured, which is located radially further toward the outside than the port of the outlet opening 13. Since the distributor parts 34 and 35 within a cryostat represent parts of a cold helium casing 42 for holding liquid helium as coolant for the superconducting coil windings, the support element 40 extending between them is at approximately the same temperature.

In the combination of frame structures 7 and 8, distributor parts 34, and 35, as well as the at least one support element 40, a relatively simple and secure supporting and holding mechanism for the superconducting coil windings lying on both sides of the equatorial plane E is ensured.

In this construction, in addition, advantageously the suspension and positioning elements of the magnetic device within a vacuum chamber of the cryostat can be applied directly to the distributor parts 34 and 35 and thus in the immediate vioinity of the superconducting coil windings 4 to 6 (not speCifically illustrated). This results in a correspondingly high positioning accuracy of the windings with respect to the particle path.

The fraction of the synchrotron radiation impinging on the support element 40 is caught by a radiation absorbing agent 46, which advisably is cooled. A preferred cryogenic cooling agent for this purpose is liquid nitrogen.

In general, each of the coil windings 4 and 5 is built up of several partial windings which enclose each other shell-like. According to the embodiment shown in FIG. 1, three such partial windings represent in each instance one coil winding. One of these partial windings, which largely corresponds to the winding of the coil winding 4, is denoted by the reference numeral 4*a*, in FIG. 2, in greater detail, in an oblique view. This partial winding labeled 4*a*′ is composed of a superconducting rectangular conductor 50, with which so-called "pancakes" 51 of 2 windings arranged in one layer next to each other are equipped. To this end the rectangular conductor 50 is laid layer by layer with its lateral width into grooves with correspondingly adjusted radial extent. The thus produced winding packet is then affixed in the grooves which, for the sake of greater clarity, are not shown in the figure. These grooves extend in at least one also not represented coil former such that the curved formed from the partial winding 4*a*′ has one convex outside 53 and one concave inside 54. In the two transition regions between these sides 53 and 54 two coil formers are formed. Of these coil formers only one is shown in the figure and denoted by 55′.

Figure 2:
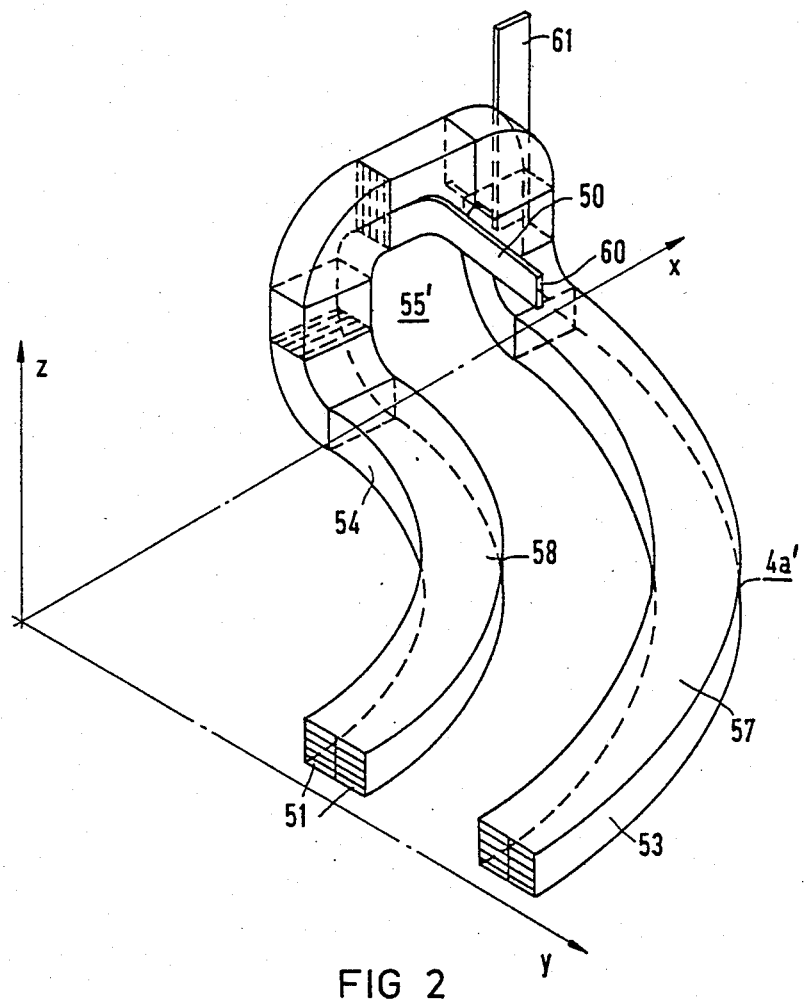
FIGS. 2 and 3 each illustrate schematically an embodiment of a partial winding for a magnetic device of the invention.

As is clearly evident from FIG. 2, the coil former overhang 55′ of the partial winding 4*a*′ does not lie in a common plane with the curved winding parts 57 and 58 forming the sides 53 and 54. The plane common to the winding parts 54 and 58 lies parallel to the plane formed by the x and y coordinates of the x-y-z system of coordinates. Instead, the partial winding 4*a*′ according to the invention, in the region of the coil end 55′, compared to the common plane, is saddle-like in the manner of a bed frame bent up, i.e., and is led out of the common plane. In particular, the winding can be bent up so far that it comes to lie in a vertical -plane extending parallel to the plane defined by the x-z plane of the coordinate system. In this connection, advantageously, a relatively small bending radius or radius of curvature can be provided. Through this bending up of the partial winding 4*a*′ at the coil former 55′ not only the influence of potential conductor motions on the field homogeneity is reduced; but the interfering influence of the conductor ends is diminished due to the correspondingly greater distances to the particle path. In FIG. 2 the winding beginning and the winding end at the coil end 55' is denoted by 60 and 61 respectively.

The above discussed embodiment was based on the superconducting coil windings 4 and 5 extending within their winding parts 57 and 58 and lying in one plane within the grooves of individual coil formers 15, 16, while at the coil ends 55' no grooves are provided. It is, of course, equally possible to provide for these parts of the windings correspondingly shaped grooves as they are, for example, known for non-curved saddle-shaped magnetic coils (cf. for example, DEP No. 1 514 445).

In addition, the two curved winding parts of the partial winding 4a' do not need to lie, as assumed in FIG. 2, in a common plane, which extends parallel to the plane determined by the particle path. As is already clearly evident in FIG. 1, the two curved winding parts can come to lie also in two different planes with different distances to the particle path plane. A corresponding model of the partial winding 4a can clearly be seen in FIG. 3, for which a representation corresponding to FIG. 2 is selected.

Figure 3:
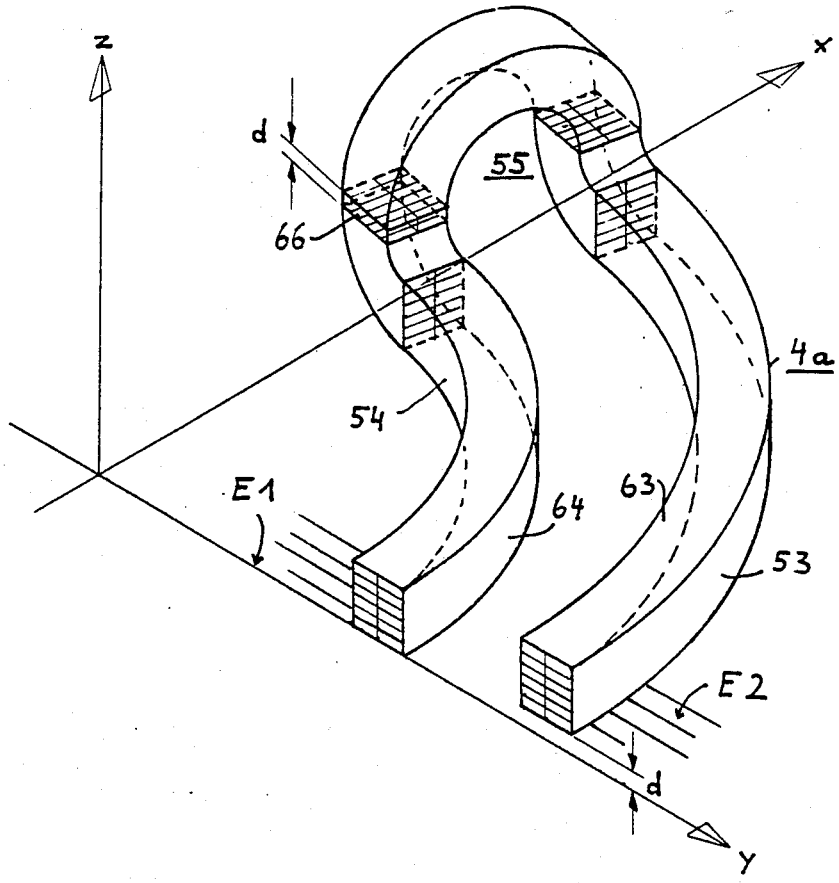

Accordingly, the partial winding 4a shown only partially developed in FIG. 3 contains a curved winding part 64 forming the concave inside 54, extending in a first plane E1. This plane is, according to the representation in the figure, for example, the x-y plane of a rectangular system of x-y-z coordinates. A winding part 63 extending parallel to this winding part 64 forming the convex outside 53 of the partial winding 4a then lies in a parallel second plane E2, at a distance d from plane E1. Within the partial winding 4a this distance, for example, at the coil end 55 can be compensated by providing a straight interpiece 66 extending in the z-direction with appropriate dimension between curved winding parts. According to the represented embodiment, the interpiece 66 is assigned to the inner winding part 64 for level compensation compared to the outer winding part 63. By appropriate selection of varying distances of the inner and outer winding parts 64, 63 to the particle path plane it is then potentially even possible, that a special gradient coil, as is provided, for example according to DEP No. 35 30 446, can be obviated.

The magnetic device according to the invention can be envisioned advantageously according to the embodiment indicated in FIG. 1 as a synchrotron radiation source with radial outlet openings for the synchrotron radiation, the measures according to the invention, however, can equally well be utilized for other types of acceleration installations with curved orbital paths for their electrically charged particles.

What is claimed is:

1. In a magnetic device arranged in a curved section of a path of electrically charged particles in an accelerator installation, said magnetic device being arranged around a beam guiding chamber and having superconducting, curved coil windings, said coil windings having convex outsides, concave insides and transition areas at the coil ends between said convex outsides and concave insides, and said coil windings comprising superconducting rectangular conductors, an improvement wherein said superconducting coil windings, at least with said convex outsides and concave insides, form winding parts arranged in grooves of correspondingly formed coil formers, said grooves extending approximately perpendicular to a plane defined by said particle path, and, further, wherein said superconducting coil windings, in the transition areas of said coil ends, are bent up saddle-shaped.

2. The magnetic device of claim 1, wherein said grooves in the coil formers extend to the coil end transition areas of said coil windings.

3. The magnetic device of either claims 1 or 2, wherein the coil formers are rigidly fastened in at least one frame structure of said magnetic device.

4. The magnetic device of claim 3, wherein two at least largely identically constructed frame structures are provided, which frame structures are joined to one another in the plane defined by said particle path.

5. The magnetic device of any one of claims 1 or 2, and further a device for mechanically fixing the coil windings in said grooves.

6. The magnetic device of claim 5, and further at least one closure part for sealing said grooves and a pressure strip arrangement at the base of each groove to press a particular coil winding against said at least one closure part.

7. The magnetic device of claim 5, wherein at least parts of said coil windings are cast in said grooves.

8. The magnetic device of either claims 1 or 2, wherein the radial extension of said grooves is adapted to the width of the rectangular conductors.

9. The magnetic device of either claims 1 or 2, wherein the rectangular conductors are arranged in the grooves stacked one above the other.

10. The magnetic device of claim 9, wherein two adjacent parts of the rectangular conductor form one layer of the conductor stack in the grooves.

11. The magnetic device of either claims 1 or 2, wherein the winding beginning and the winding end of each coil winding are located in the transition area of the coil end.

12. The magnetic device of either claims 1 or 2, wherein the winding parts forming the convex outsides and the winding parts forming the concave insides of said coil windings are arranged at varying distances to the particle path plane, relative to one another.

* * * * *